US007587868B2

(12) United States Patent
Hughes

(10) Patent No.: US 7,587,868 B2
(45) Date of Patent: Sep. 15, 2009

(54) METHOD OF INSTALLING WINDOWS INTO A CONCRETE STRUCTURE

(76) Inventor: Scott Hughes, 8135 Greenbrier St., Dexter, IA (US) 50070

( * ) Notice: Subject to any disclaimer, the term of this patent is extended or adjusted under 35 U.S.C. 154(b) by 557 days.

(21) Appl. No.: 11/308,084

(22) Filed: Mar. 6, 2006

(65) Prior Publication Data

US 2007/0204535 A1 Sep. 6, 2007

(51) Int. Cl.
*E06B 1/04* (2006.01)

(52) U.S. Cl. ..... 52/215; 52/745.15; 52/205

(58) Field of Classification Search ..... 52/216, 52/215, 745.15, 205; 249/39
See application file for complete search history.

(56) References Cited

U.S. PATENT DOCUMENTS

| | | | | | |
|---|---|---|---|---|---|
| 1,640,595 | A | | 8/1927 | Buss | |
| 2,416,559 | A | * | 2/1947 | Wilson | 249/16 |
| 2,787,820 | A | | 4/1957 | Shields et al. | |
| 3,156,331 | A | * | 11/1964 | Sklar | 52/215 |
| 3,769,769 | A | | 11/1973 | Kohl | |
| 3,835,586 | A | | 9/1974 | Gates et al. | |
| 3,994,470 | A | * | 11/1976 | Nakada | 249/93 |
| 3,995,843 | A | | 12/1976 | Kasteler | |
| 4,138,084 | A | | 2/1979 | Reid | |
| 4,159,098 | A | * | 6/1979 | Wong | 249/61 |
| 4,430,831 | A | | 2/1984 | Kemp | |
| 5,055,252 | A | * | 10/1991 | Zimmerman | 264/263 |
| 5,169,544 | A | | 12/1992 | Stanfill et al. | |
| 5,791,103 | A | * | 8/1998 | Coolman et al. | 52/215 |
| 5,996,293 | A | | 12/1999 | Anderson et al. | |
| 6,453,620 | B1 | | 9/2002 | Williams et al. | |
| 6,904,727 | B2 | | 6/2005 | Edger | |
| 6,922,958 | B2 | | 8/2005 | Derderian | |

* cited by examiner

*Primary Examiner*—Richard E Chilcot, Jr.
*Assistant Examiner*—Anthony N Bartosik

(57) ABSTRACT

A method of installing a window into a concrete wall. The method includes taking a frame and securing a sub-frame thereto to form a buck. A bracing member is then fastened to the buck and the buck is positioned within a concrete wall form. Once the window is properly positioned and secured in the form the concrete is poured. After the concrete dries the bracing member is removed and a window pane is attached to the frame to create a window.

6 Claims, 7 Drawing Sheets

METHOD OF INSTALLING WINDOWS INTO A CONCRETE STRUCTURE

BACKGROUND OF THE INVENTION

This application relates to a method of installing a window into a concrete wall. More specifically this application relates to a method of using a bracing member in order to place a window of any size or shape in any location within a concrete wall.

Most concrete walls require windows that are screwed into the concrete and caulked in place. Other windows are formed from steel window bucks that are set in place and then concrete is poured around the window bucks to form the window opening. These type of windows have energy inefficiencies because once installed they have a tendency to leak water and air into a room. Also there are problems with the extreme forces that are placed upon the window buck during the pouring of the concrete.

In addition, steel frames in cold climates frost up and leak water into a building. Vinyl frames tend to move a significant amount in concrete due to the expansion and contraction of vinyl allowing water to freeze and break the vinyl. After time vinyl moves in the concrete to hinder the operation of the window.

Wood frames produced on the job site or in a factory setting are either stripped after installation or are allowed to be retained in the concrete, and in both cases will leak if not maintained over the life of the product. Specifically, wood left in the concrete and not sealed on the exterior will leak water in its lifetime. Conversely, wood removed and windows installed into the concrete will require significant maintenance with caulk over its life to prevent leakage.

Needed is a system or method of installing windows that provides windows that are placed in concrete that are as good as current systems used in homes. Specifically once installed and designed builders desire windows that when tested will perform to the requirements needed for energy conservation desired by building requirements.

Therefore it is a principal object of the present invention to provide a method of installing windows in a concrete wall in a quick and efficient manner.

Another object of the present invention is to provide a method for installing a window that provides a window that is able to conserve energy and meet all test requirements once installed.

Yet another object of the present invention is to provide a cost effective means and method for installing windows into a concrete wall.

These and other objects, features, or advantages of the present invention will become apparent from the specification and claims.

BRIEF SUMMARY OF THE INVENTION

A method and means for installing windows into a concrete wall. The apparatus is a window buck that is a combination of a frame member and a sub-frame member that are secured together and are of size and shape of the desired window. The method involves securing a brace member to the buck and positioning the buck within a concrete form. Once in the proper position of the buck is determined the buck is secured in place. Once secured in place, concrete is poured around the frame and sub-frame and after the concrete has dried the bracing member is extracted. Then the window is attached to the wood frame.

DETAILED DESCRIPTION OF THE PREFERRED EMBODIMENT

Figure 1:
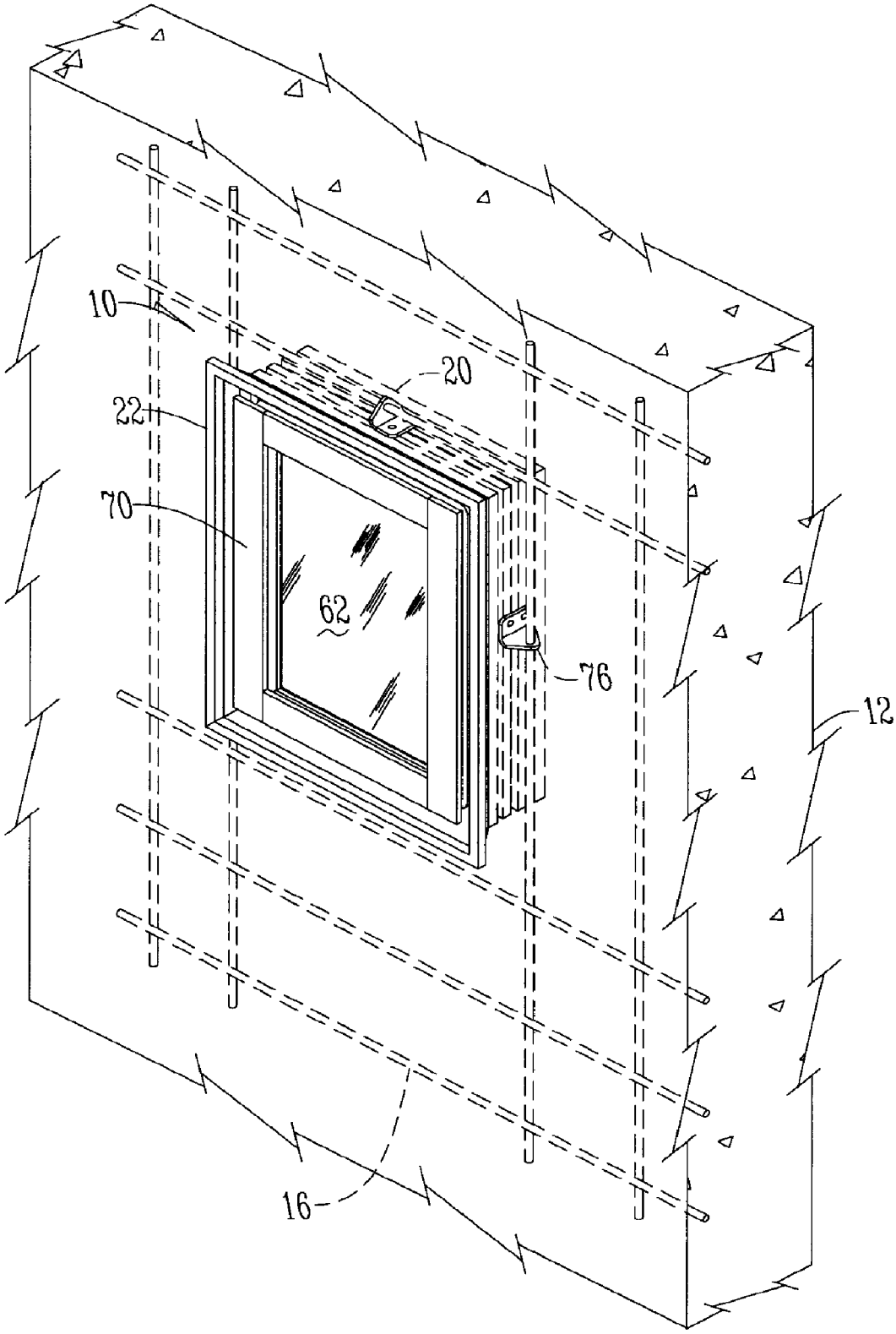
FIG. 1 is a perspective view of a window buck installed within a concrete form.

FIG. 1 shows a window buck 10 that is placed within a concrete wall form 12 that has an opening for a window and rebar 16 disposed therein. Though described as a buck 10 for a window, the buck 10 can also be used to form other openings within a concrete form 12, such as a doorframe or the like. The concrete form 12 is used such that concrete is poured within the form 12 and then after the concrete dries the form is removed to create a concrete wall.

Figure 2:
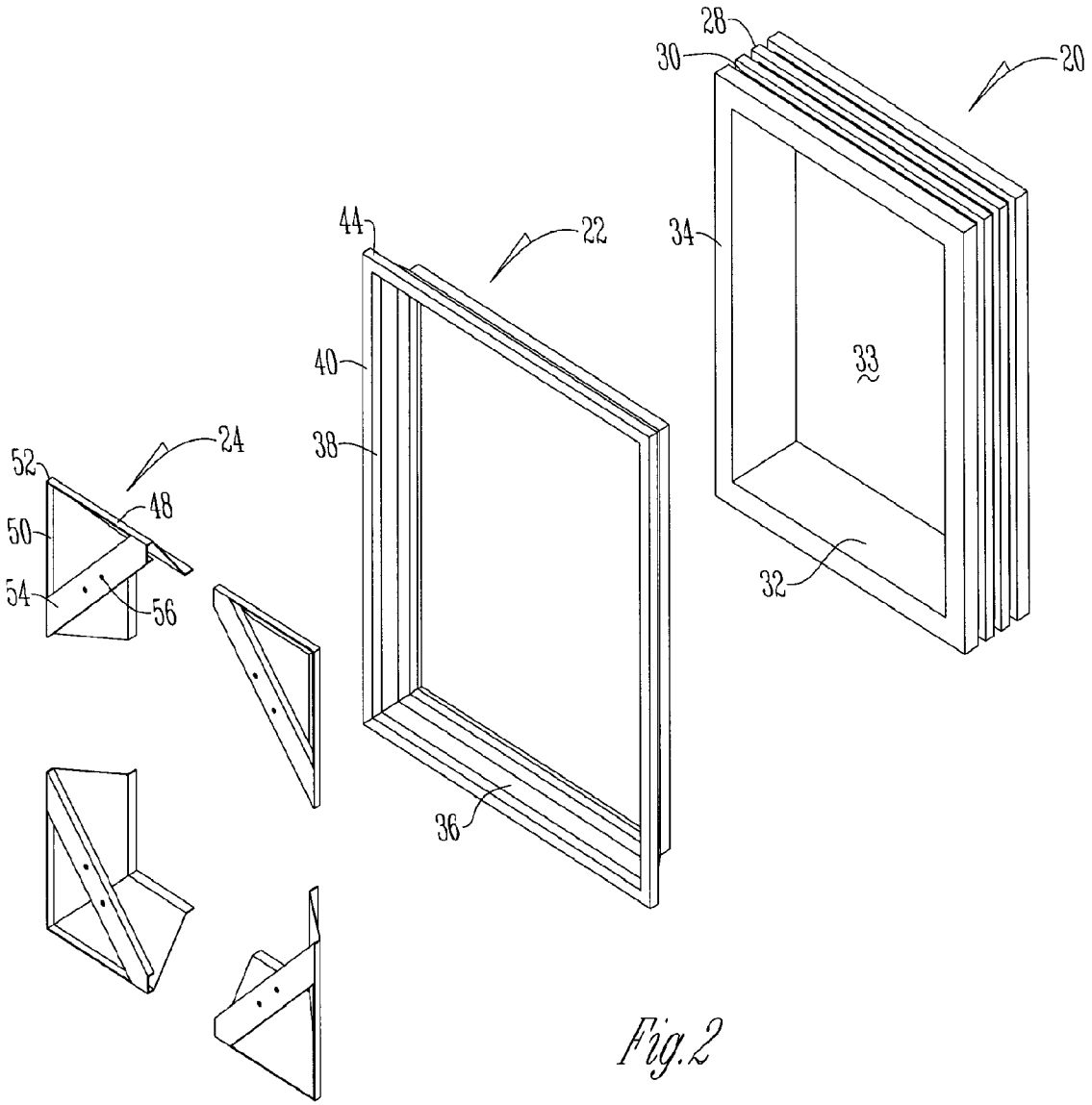
FIG. 2 is an exploded perspective view of a window buck and a bracing member.
Figure 3:
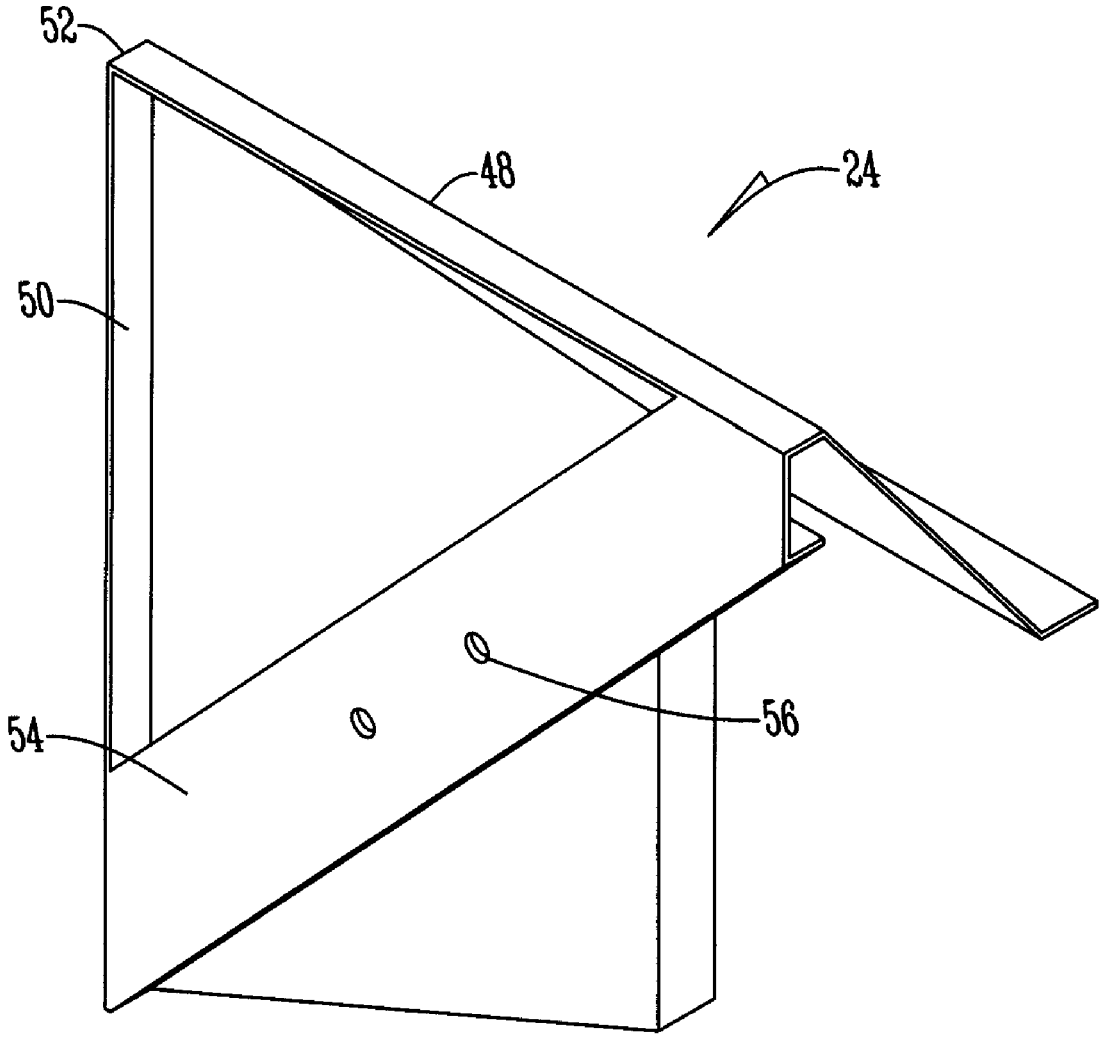
FIG. 3 is a perspective view of a bracing member.
Figure 4:
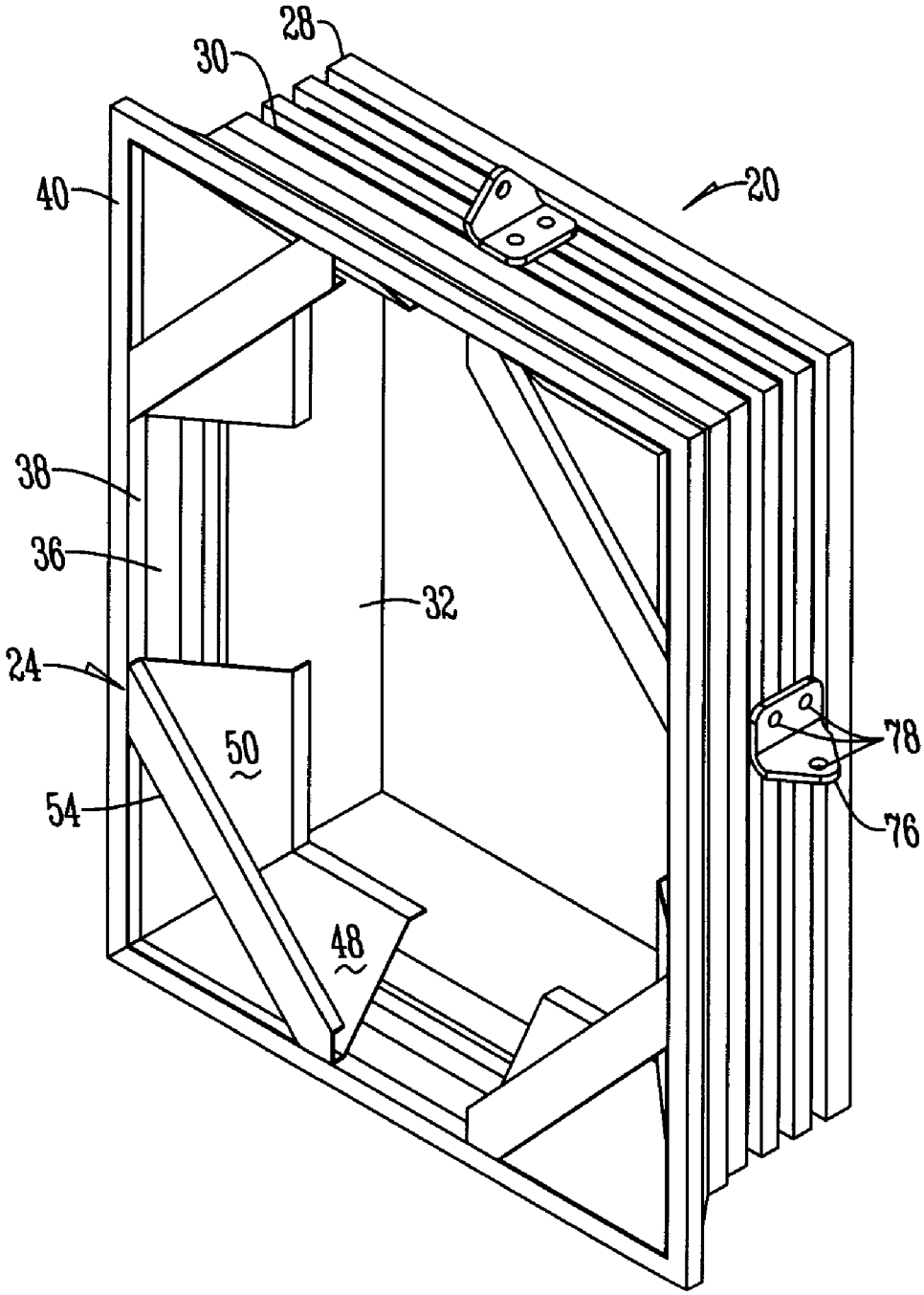
FIG. 4 is a perspective view of a window buck with bracing members and fins attached thereto.

FIG. 2 shows a window buck 10 having a frame 20 that is secured to a sub-frame 22. The frame 20 and sub-frame 22 are used in combination with bracing member 24 and window pane 26 (FIG. 6) to install the window.

In a preferred embodiment the frame 20 is made of wood and has an exterior surface 28 that consists of a plurality of grooves 30 therein such that when concrete is poured within the grooves 30 and the concrete dries the exterior surface 28 and the concrete form an interlocking connection to provide an improved sealing. The frame 20 also has an interior surface 32 that surrounds an opening 33, and a front face 34. By using wood as the material within the frame instead of a material such as steel, less water and cold air is allowed to pass through the window opening and the wood provides better insulation as compared to steel.

Secured to the exterior 30 and face 34 of the frame 20 is the sub-frame 22. The sub-frame 22 in a preferred embodiment is made of a plastic material. The sub-frame 22 consists of a first planar surface 36 and a second angled surface 38 that terminates in a squared off end having a top face 40 and forming a groove. During installation when concrete is poured within groove again an interlocking effect is present. For extra sealing protection the exterior 44 of the sub-frame 22 has a sealing material at corners of the sub-frame 22. Though in a preferred embodiment the window buck 10 is shown as a two-piece frame 20 and sub-frame 22 assembly the buck 10 could be a single member. Additionally, in a preferred embodiment the buck 10 is shown as a rectangular shape; however, different shapes such as arches and the like fall within the scope of this application.

The bracing member 24 comprises first and second Z-shaped members 48 and 50 that are secured together at a point 52. Extending across and secured to the first and second z-shaped members 48 and 50 is a support member 54 that contains a plurality of openings 56 therein. Because of the z-shape of the z-shape members 48 and 50 the bracing member 24 snuggly fits within the sub-frame 22 within the second angled surface 38 such that the top of the z-shaped members 48 and 50 are flush with the face 40 of the sub-frame 22. The bottom portion of the z-shaped members 48 and 50 simultaneously aligns adjacent to the interior 32 of the frame 20. Thus the bracing member is secured to the frame 20 and sub-frame 22 in order to brace the frame 20 and sub-frame 22 when concrete is poured into the form 12.

Figure 6:
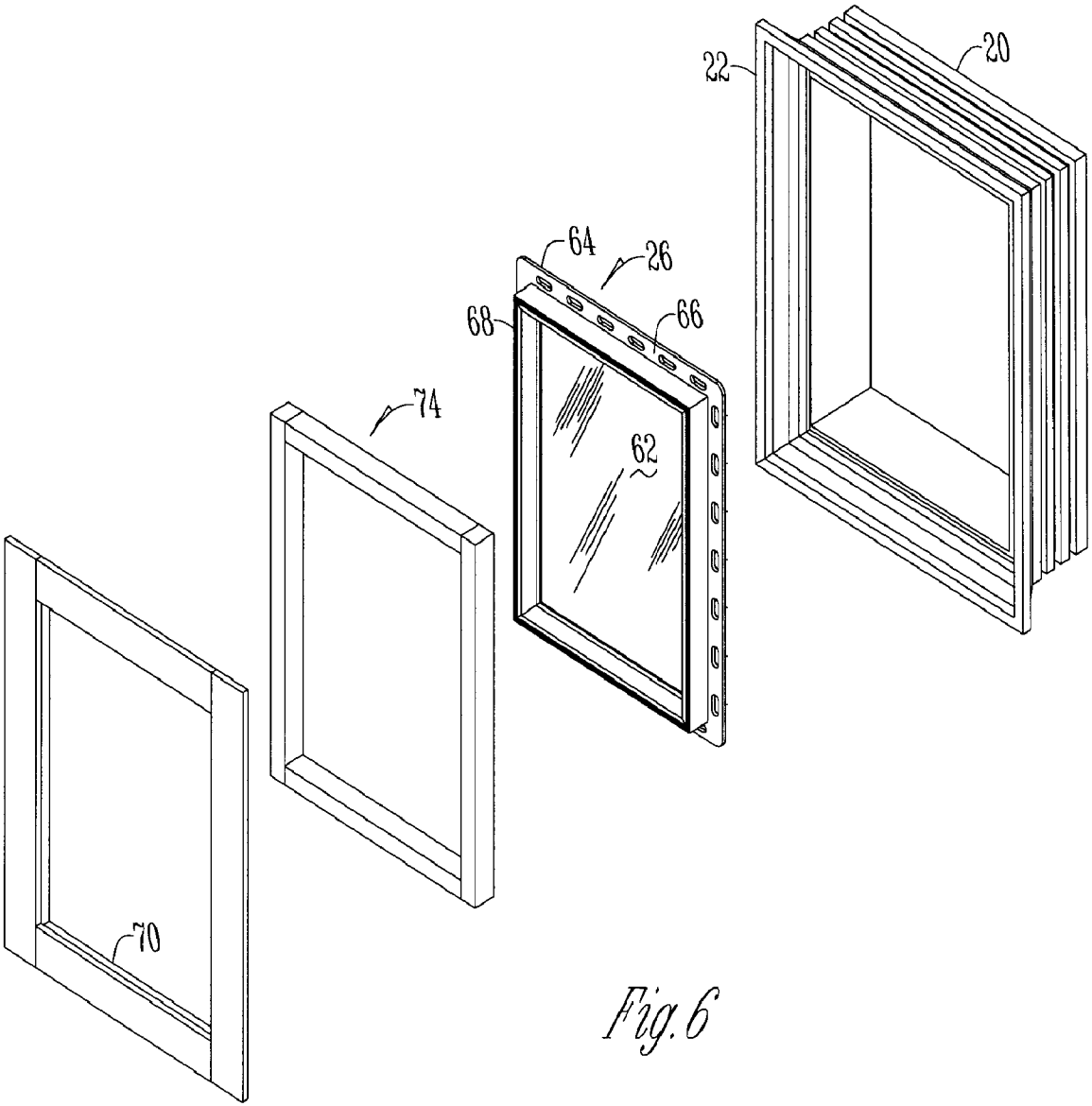
FIG. 6 is an exploded perspective view of a window buck in combination with a window pane, blocking, and J-trim.
Figure 7:
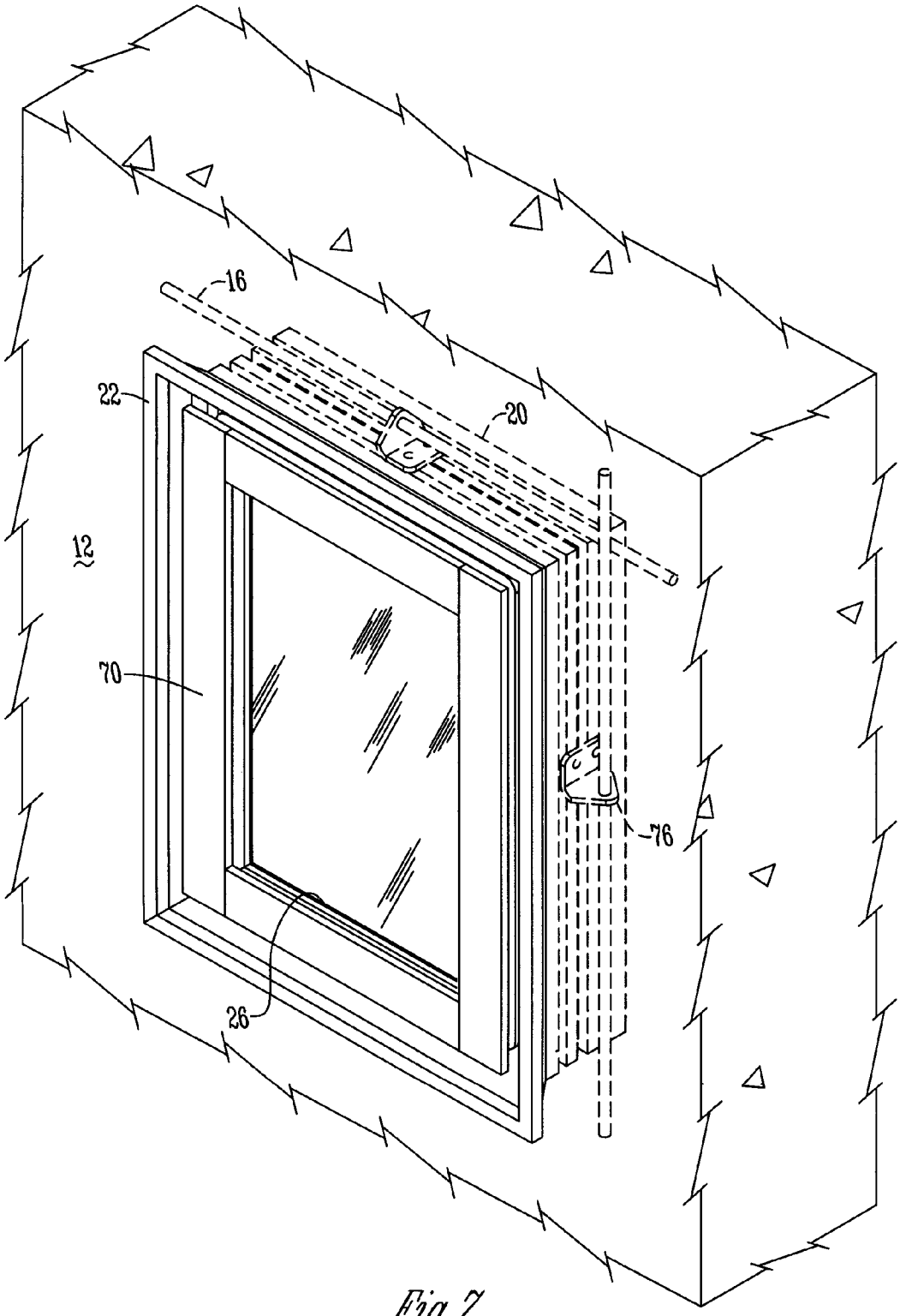
FIG. 7 is a plan view of a fully installed window.

The window pane 26 generally has a transparent window 62 and has a perimeter 64 with a plurality of slotted openings 66. Additionally adjacent the perimeter 64 is a slot 68 that will receive J-trim 70 (FIG. 6). When the window pane 26 is placed within the buck 10 the perimeter 64 is secured to the frame 20. When the window pane 26 is secured to the frame 20 a space is created between the window pane 26 and the sub-frame 22. This space in one embodiment is filled with a caulking material or in an alternative embodiment with sealing tape.

Once the window pane 26 is secured to the frame 20 a member such as a wooden block 74 is placed over the perimeter 64 to add insulation. The block 74 is covered when J-trim 70 is inserted into slot 68, thus concealing the block 74 and perimeter 64 of the pane 26 to provide an aesthetically pleasing look. If a window with brick mold trim is used, the J-trim 70 and block 74 are unneeded.

Figure 5:
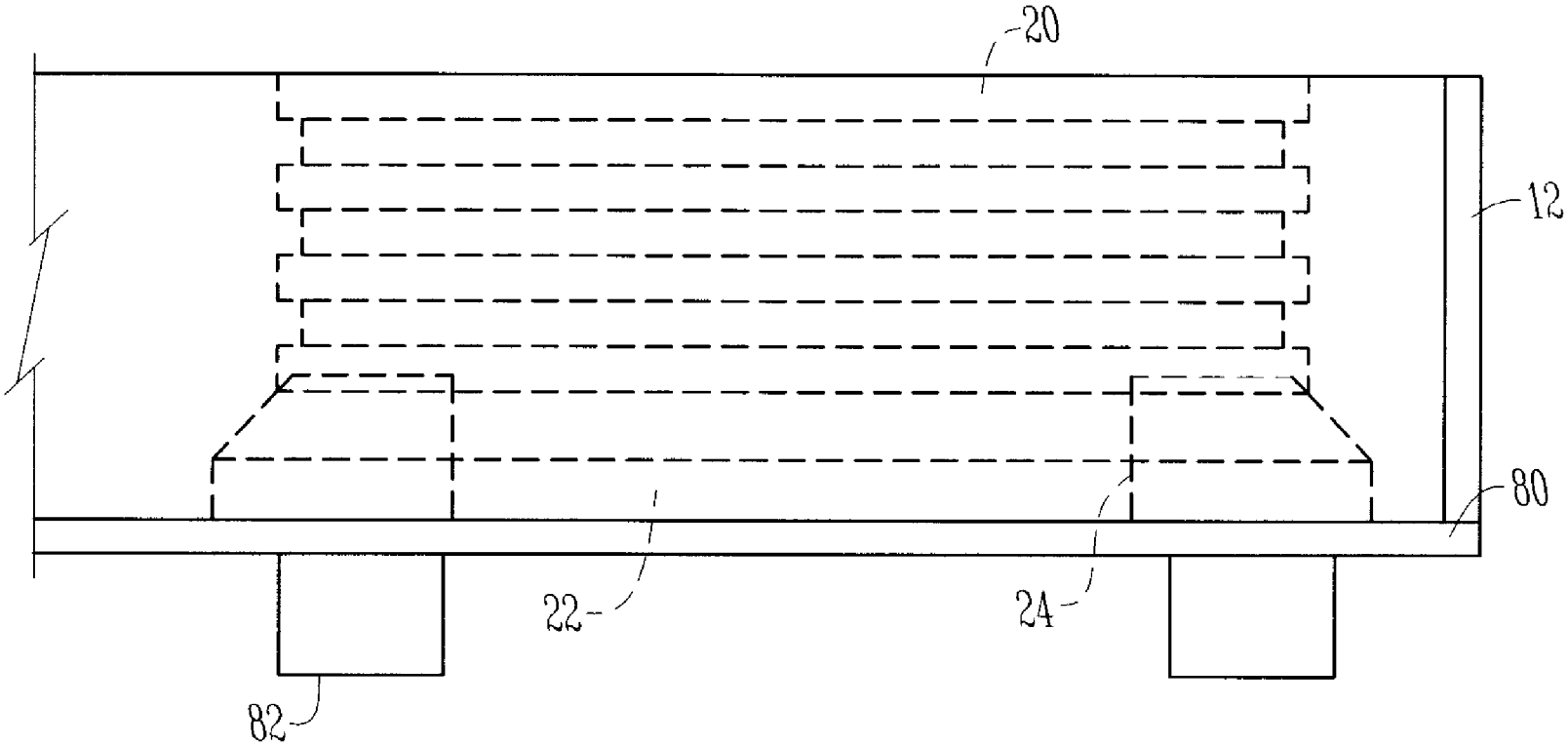
FIG. 5 is a perspective view of a window buck within a concrete form having a bracing member that is located by a magnet for a pre-stress concrete bed to position within the wall.

The buck 10 can be used to install a window for a concrete wall that is created on a worksite using forms 12 and rebar 16, or within a pre-made concrete wall that is shipped to a worksite (FIG. 5). Using either method, first the frame 20 is created. The frame 20 is made of any material and of any size and shape that is desired by a customer.

The next step of installation involves creating a sub-frame from any waterproof material such as plastic, Fiberglas, or the like. Once the sub-frame 22 is created the sub-frame 22 is secured to the frame 20 to form buck 10. Then the bracing member 24 is placed into the buck 10 and secured to at least one of the frame 20 or sub-frame 22. At this time waterproof tape is secured at the corners of the sub-frame to improve insulation.

When forming a window at a worksite the location of the window is selected. Then laterally spaced apart rebar 14 is removed from the concrete form 12 to accommodate the size and shape of the buck 10. At least one fastening device, or fin 76 having a plurality of openings 78 therein is secured to the frame 20. Rebar 14 is disposed through the openings 78 to add structural strength around the window buck after concrete has cured. This also prevents cracks from forming.

When constructing a pre-fabricated wall (FIG. 5), the wall is formed on a steel bed 80. The bracing 24 is held into position with magnets 82 on the bed 80, thus preventing the buck 10 from moving.

In both instances, once the concrete is poured and is dried the forms 12 are taken away to expose the newly created concrete wall having a window buck 10 therein. Then the bracing member 24 is removed from the buck 10.

The next step involves securing a window pane 26 to the frame 20 such that the window is installed. In another embodiment a sliding door similarly could be secured to the face 34 of the frame 20 to cover the opening 33 therein. Any type of window pane 26 or door may be installed including aluminum, vinyl or wood.

The next step of installation is to seal the gaps or spaces in between the window pane and the sub-frame 22 with sealant tape, caulk, or the like. Once this space is sealed, the treated wood block 74, brick molding, or the like is placed in the groove created between the window pane 26 and sub-frame 22 to provide additional insulation. At this time J-trim 70 is placed into the window pane slot 68 and snapped into place to hide the wood block 74 within the groove to finalize the distinct window.

By utilizing this method a bracing member 24 may be reused to install a plurality of windows making the method cost effective. Additionally because of the multiple layers of sealant that are employed energy losses out of the window are minimized. By using the fastener 76 or magnet 82 the window is placed at any location within the concrete wall. Thus at the very least all of the stated objectives have been met.

It will be appreciated by those skilled in the art that other various modifications could be made to the device without the parting from the spirit in scope of this invention. All such modifications and changes fall within the scope of the claims and are intended to be covered thereby.

What is claimed is:

1. A method of installing a window into a concrete wall the steps comprising:

forming a window buck having a frame secured to a sub-frame;

securing a bracing member to an interior periphery of the window buck;

placing the window buck in a horizontal concrete wall form against a bed securing the bracing member to the bed with a magnet placed on an exterior of the bed on a side opposite of the window buck;

pouring concrete around the window buck;

removing the bracing member; and securing a window pane to the window buck.

2. The method of claim 1 further comprising the step of placing sealing tape on corners of the sub-frame.

3. The method of claim 1 further comprising the step of placing sealing tape between the frame and sub-frame to seal spaces.

4. The method of claim 1 further comprising caulking spaces between the window pane and the sub-frame.

5. The method of claim 1 further comprising the step of securing a block between the window and sub-frame.

6. The method of claim 5 further wherein the window pane has a slot disposed therein and J-trim is secured in the slot to cover the member between the window and sub-frame.

* * * * *